US005456094A

United States Patent [19]

Greenwald

[11] Patent Number: 5,456,094

[45] Date of Patent: Oct. 10, 1995

[54] CLASP FOR PIERCED EARRINGS

[76] Inventor: Robert J. Greenwald, 2000 S. Tamiani Trail, Venice, Fla. 34293

[21] Appl. No.: 240,161

[22] Filed: May 9, 1994

[51] Int. Cl.[6] ..... A44C 7/00

[52] U.S. Cl. ..... 63/12; 24/705

[58] Field of Search ..... 63/12, DIG. 3; 24/705, 706.9

[56] References Cited

U.S. PATENT DOCUMENTS

| | | | |
|---|---|---|---|
| 161,853 | 4/1875 | Baker | 63/12 |
| 4,067,341 | 1/1978 | Ivey | 63/12 |
| 4,593,540 | 6/1986 | Cuvar | 63/12 |
| 4,771,613 | 9/1988 | Grier | 63/12 |
| 4,829,788 | 5/1989 | DiDomenico | 63/12 |
| 5,018,365 | 5/1991 | Luceno | 63/12 |
| 5,154,068 | 10/1992 | DiDomenico | 63/12 |

*Primary Examiner*—Flemming Saether
*Attorney, Agent, or Firm*—Gifford, Krass, Groh, Sprinkle, Patmore, Anderson & Citkowski

[57] ABSTRACT

An earring assembly in which the earring has a post to pass through a pierced opening in the earlobe of a wearer to receive a clasp to hold the earring securely in position with the clasp being formed of plastic material with a head to be located behind the ear lobe of the wearer and a tubular sleeve projecting from the head to be located within the pierced opening in the ear lobe and receiving the post to completely isolate the earring from the flesh of the wearer and to limit the spacing of the earring ornament and clasp to avoid pressure on the ear lobe. The clasp is easily cut with readily available tools for modification to accommodate the thickness of the wearers ear lobes and the positioning of adjacent earrings.

11 Claims, 1 Drawing Sheet

CLASP FOR PIERCED EARRINGS

BACKGROUND OF THE INVENTION

This invention relates to jewelry and more particularly to earrings to be worn in pierced ears.

Earrings which are mounted in holes pierced in the ear lobe of a wearer often include an ornament portion mounted on a post which passes through the ear lobe opening and a clasp fitted on the end of the post opposite to the ornament. Such earrings can cause many problems by way of discomfort, infection and minor disfigurement. For example, some wearers are allergic to certain metal from which the earrings may be made and when the flesh of the ear lobe is exposed there is a sensitive reaction and possible infection.

Still another problem with pierced earrings is that the clasp on the post of the earring may compress the ear lobe to cause tissue damage and discomfort. Additionally, the post must have a very small diameter to be received in the opening in the ear lobe. However, small post supports the entire weight of the earring and particularly when heavy earrings are worn, the ear lobe is stretched to an elliptical shape which eventually may lead to a torn ear lobe.

In addition to health and comfort problems it is necessary that earrings worn in pierced ear lobes be provided with a secure clasp to insure against accidental displacement or loss.

To avoid some of the problems enumerated above, earrings or at least the mounting post are made of gold or other hypoallergenic metals which are very expensive and increases the cost.

In an effort to overcome the problems of secure clasps, the posts of earrings are frequently made longer than necessary which leads to additional problems such as that caused by the extended portion of the post poking the wearer in the neck. The resultant discomfort also sometimes requires that the earring must be completely removed in order for the wearer to use earphones or the telephone.

Another problem with earring mounting systems is that the clasps at the rear or behind the ear lobe are unattractive or so obvious that they distract from the ornamental, decorative purpose of the earring.

SUMMARY OF THE INVENTION

It is an object of the invention to provide an earring clasp which makes it possible to avoid the application of pressure on the ear lobe Another object of the invention is to provide a clasp which will shield the end of the post so that it does not poke the neck of the wearer.

A further object of the invention is to provide an earring clasp which can be customized to accommodate the thickness of the ear lobe of the wearer.

Another object of the invention is to provide an earring clasp which can be customized to accommodate adjacent earrings and their clasps.

An additional object of the invention is to provide an earring clasp which not only is economical but also is not obvious or unattractive and does not distract from the appearance of the earring assembly.

Still another object of the invention is to provide a clasp which will isolate the earring and its post from the flesh of the wearer to avoid allergies or infection.

The purposes of the invention are accomplished by an earring assembly in which the earring itself has an ornament portion and a post projecting away from the ornament and a clasp portion which is adapted to frictionally engage the post after it has been positioned within a pierced opening in the ear of the wearer to hold the earring in position. The clasp includes a sleeve and flange portion disposed at one end of the sleeve with the flange and sleeve acting together to form an axial passage which receives the earring post. The clasp is positionable with the sleeve disposed in the pierced opening in the ear of the wearer with the flange disposed behind the ear lobe. The post is disposed within the axial passage to position the earring ornament at the front or lateral side of the ear lobe in which case the sleeve engages the earring ornament portion to limit the spacing of the flange and the earring ornament to accommodate the thickness of the ear lobe. In its worn position the clasp grips the earring post to prevent separation and also acts to isolate the post from the wearer to avoid any problems of an allergic reaction or infection. The clasp is made of a homogeneous, plastic material which performs the function of hypoallergenic materials and is easily cutable so that the earring clasp can be customized both as to the thickness of the ear lobe of the wearer and to accommodate other closely adjacent earrings for which the space may be limited

DETAILED DESCRIPTION OF A PREFERRED EMBODIMENT

Figure 1:
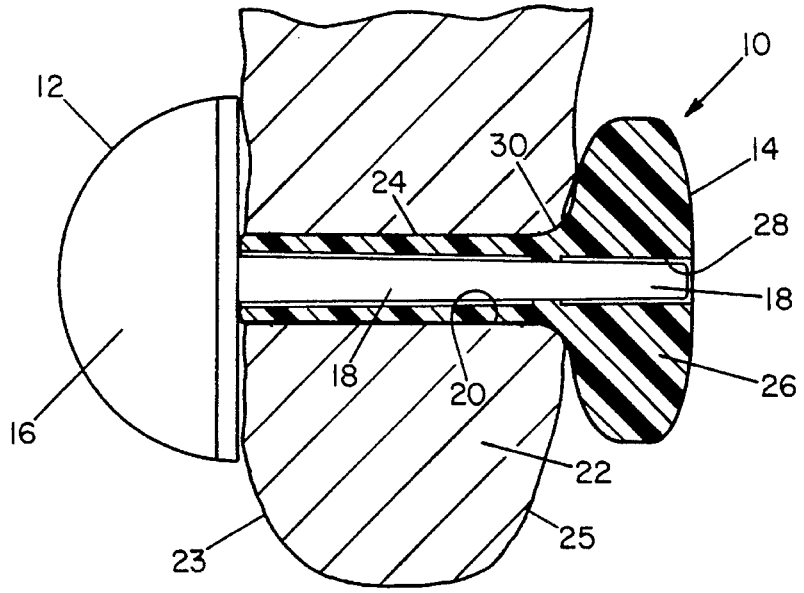
FIG. 1 is a cross-sectional side elevation showing an earring assembly embodying the invention shown in position relative to the ear lobe of a wearer.
Figure 2:
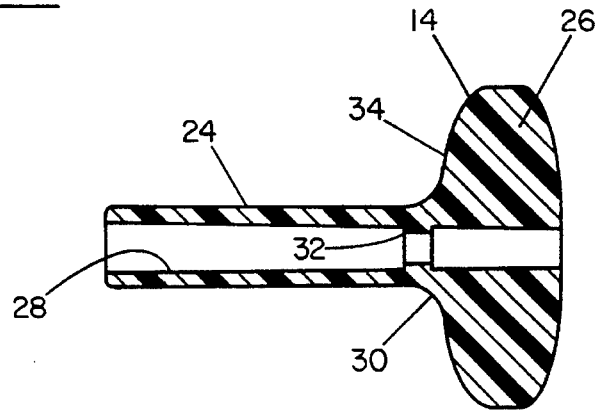
FIG. 2 is a side elevation and cross-section showing the clasp of the earring alone, separate from the earring post and the ear lobe of the wearer.
Figure 3:
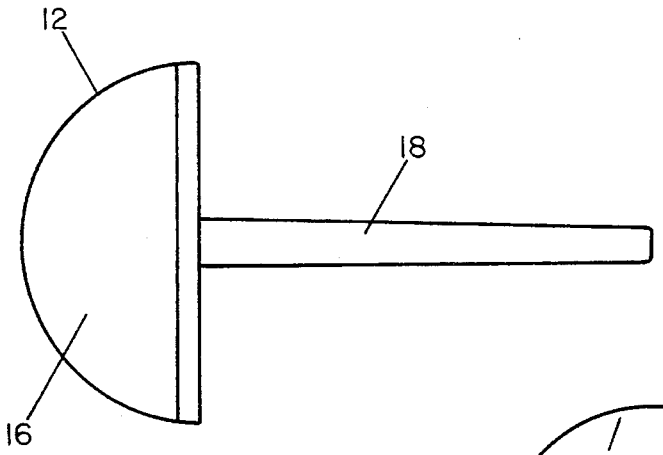
FIG. 3 is a side elevation of the earring.

Referring now more specifically to the drawings, the earring assembly embodying the invention is designated generally at 10 and includes an earring portion 12 and a clasp 14

The earring 12 includes an ornament portion 16 and a post 18 extending from the ornament Such earrings are adapted to be worn with the post 18 in a pierced opening 20 in an ear lobe 22 of a wearer so that the ornament 16 is disposed at the outer or face side 23 of the ear lobe and the clasp 14 is positioned behind the ear lobe at the rear side 25 of the ear lobe to hold the earring 12 in position.

In the preferred embodiment of the invention, the clasp 14 include a tubular sleeve 24 and a head portion 26 at one end of the sleeve. The sleeve 24 is generally tubular and is Joined to the head portion 26 so that the passage 28 in the sleeve extends completely through the head 26 A fillet 30 Is . formed at the location of the sleeve 24 and its juncture with the head 26 to act as a reinforcement and to maintain the sleeve in a proper orientation relative to the head 26 The clasp 14 is formed as a single unitary member and is made of a soft resilient plastic material such as a low density polyethylene which can be easily cut.

By way of example, an actual embodiment of the invention which operated successfully was made of a clear, low density polyethylene and had dimensions of 0.375 inches (9.525 mm) overall length and a head or flange diameters of 0.25 inches, (12.7 mm) an outside sleeve diameter of 0.052 inches (1.3 mm) and an axial passage with an inside diameter of 0.032 inches (0.8 mm).

In use, the earring assembly 10 is attached to an ear lobe 22 by inserting the sleeve 24 of the clasp 14 into the opening 20 in the ear lobe from behind the ear lobe so that the head portion 26 of the clasp 14 is positioned at the rear surface 25 of the ear lobe. Thereafter, the post 18 of the earring 12 can be inserted into the exposed end of the axial passage 28. In the alternative, the post 18 of the earring can be inserted into the pierced ear lobe first and thereafter the clasp 14 may be fitted onto the free end of the post until the sleeve 24 is within the opening 20. In either case, the earring 12 and clasp 14 can be pressed together until the free end of the sleeve 24 abuts the earring to limit any further relative movement If the earring post 18 is longer than the length of the axial passage 28, the excess of the post can be cut away and removed Under such conditions the earring assembly 10 has been customized to accommodate the thickness of the ear lobe of the wearer so that in the assembled condition, the end of the sleeve 24 abuts the earring 12 to prevent additional compression of the two parts relative to each other. If the post 18 of the earring is longer than the length of the axial passage 28 the post 18 can be positioned so that the free end is adjacent to the head end of the sleeve and remains concealed within the passage 28 In that manner the head acts to protect the wearer from being poked.

The clasp 14 is made of a plastic material such as a low density polyethylene and is easily formed and modified by cutting with ready available tools such as scissors or finger nail clippers. Preferably, the wearer cuts the sleeve 24 of the earring clasp 14 to reflect the thickness of the ear lobe. This can be accomplished by inserting the sleeve 24 of a clasp in the ear lobe and cutting off any excess. Thereafter, with the post 18 of the earring 12 inserted in the clasp 14 with the free end of the sleeve engaged with the ornament portion 16 of the earring, any protruding portion of the post can be cut away and removed.

After customizing the clasp 14 an earring 12 can be pressed together and the spacing will be limited by engagement of the end of the sleeve with the earring ornament so that no pressure is applied to the ear lobe. Moreover, the post 18 will not protrude from the head portion 26 so that the wearer will not be poked by the end of the post.

In the assembled condition of the earring 12 and clasp 14 a friction means is formed by an annular protrusion 32 which preferably is disposed adjacent to the head or flange 26. The pliable plastic material from which the clasp 14 is made permits deflection of the protrusion 32 to permit sliding movement of the post to its selected position but at the same time frictionally resists separation of the earring 12 and clasp 14 until the earring 12 is removed To remove the earring 12 it is usual to grip the head portion 26 while the sleeve 24 remains in the opening 20 of the ear lobe The ornament portion 16 can be gripped to pull the post 18 from the axial passage 28 After removal of the earring 12 the clasp 14 can be left in position with the sleeve 28 in the ear lobe in readiness to receive another earring or if desired the clasp 14 can be removed completely from the ear lobe.

Figure 4:
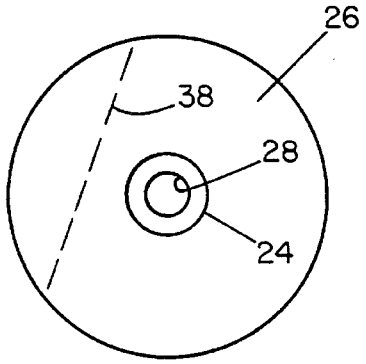
FIG. 4 is an end view of the earring clasp illustrating a possible trim pattern to accommodate other earring clasps.

It has become fashionable to wear more than one earring in an ear. In such cases the earrings may be placed in close proximity to each other and if the head portions 26 of clasp 14 overlap or interfere with each other, any excess amount may be cut and removed. For example, as viewed in FIG. 4, the flange 26 may be cut along a line such as that indicated at 38. For this purpose the head or flange 26 is formed with curved FACE surfaces 34 to facilitate handling and to give access for trimming.

In some cases and for various reasons, a wearer may prefer to have the earring post 18 exposed in the opening 20 of the ear lobe 22. In that case the clasp 14 may be used by reversing it end for end. The post 18 is received in the head 26 of clasp 14 and inserted first through the end of the passage 28 in the head 26 and into the sleeve. Under those circumstances the head 26 serves to retain the earring 12 in position and the sleeve 24 extends away from the head 26 and ear lobe to act as a handle to facilitate manipulation of the clasp 14 during placement on the post 18 of the earring.

By making the clasp 14 of a plastic material the clasp may be transparent or of various colors. When made of transparent or flesh colored, the clasp 14 is not noticeable to distract from the ornamentation of the earring.

An earring clasp has been provided which positively grips the earring post to prevent separation and at the same time limits pressure applied to the ear lobe and shields the earring post from the neck of a wearer. Additionally, the earring post may be customized to the size of the ear lobe of the wearer and to accommodate closely adjacent earrings.

I claim:

1. An earring assembly comprising:

an earring having an ornamental portion and a post projecting therefrom, a clasp adapted to engage said post, said clasp comprising a sleeve having a flange formed as a unitary structure of plastic material with said sleeve at one end of said sleeve and having a free end spaced from said flange, said sleeve and said flange forming an axially extending passage with an inside diameter sufficiently large to receive said post, said clasp being positioned in a pierced opening in an earlobe of a wearer with said flange disposed to the rear side of the earlobe and said free end of said sleeve extending to the front of said earlobe, said earring being positionable with said post in said passage with said ornament portion at the front of said earlobe in engagement with said free end of said sleeve to limit axial movement of said flange and ornament portion towards each other to limit pressure on said earlobe; and friction means in said axially extending passage to engage said post and resist separation of said earring and post.

2. The combination of claim 1 wherein said friction means is an annular projection formed in said passage as a unit with said sleeve.

3. The combination of claim 1 wherein said sleeve made of a plastic material is easily cut whereby said sleeve may be made of a selected length.

4. The combination of claim 1 wherein said head portion is generally circular and said sleeve extends axially from one side of said head portion.

5. The combination of claim 2 wherein said head portion has a curved symmetrical surface adjacent to said sleeve to maintain the outer circumference of said head portion spaced from the ear lobe of the wearer to afford access for handling or cutting said head portion.

6. The combination of claim 2 wherein a fillet is formed adjacent the juncture of said head and said sleeve to reinforce said sleeve relative to said head.

7. The combination of claim 1 wherein said head portion is made of plastic material which is easily cut whereby segments of said head portion may be removed to afford clearance with adjoining earring clasps.

8. The combination of claim 1 wherein said sleeve is positionable on said post to be disposed within a pierced opening in an ear lobe to isolate said post from said ear lobe.

9. The combination of claim 1 wherein said sleeve is positioned in a selected first or second position, said first position having said sleeve disposed in a pierced hole in an ear lobe and said second position wherein said sleeve extends away from said earlobe to offer a handle for manipulating said clasp.

10. The combination of claim 1 wherein said clasp is made of readily cuttable material and said sleeve is cut to a length substantially equal to the thickness of the ear lobe of a wearer.

11. The combination of claim 1 wherein said post is of a length no greater than the length of said axial passage.

* * * * *